US007331157B2

(12) United States Patent
Brown

(10) Patent No.: US 7,331,157 B2
(45) Date of Patent: Feb. 19, 2008

(54) CAPPING DEVICE WITH FORCE ADJUSTMENT MECHANISM AND METHOD OF ADJUSTING

(75) Inventor: Michael J. Brown, Baltimore, MD (US)

(73) Assignee: ADCOR Industries, Inc., Baltimore, MD (US)

( * ) Notice: Subject to any disclaimer, the term of this patent is extended or adjusted under 35 U.S.C. 154(b) by 0 days.

(21) Appl. No.: 11/538,722

(22) Filed: Oct. 4, 2006

(65) Prior Publication Data

US 2007/0084152 A1 Apr. 19, 2007

Related U.S. Application Data

(60) Provisional application No. 60/723,390, filed on Oct. 4, 2005.

(51) Int. Cl.
*B65B 3/20* (2006.01)

(52) U.S. Cl. ..... 53/331.5; 53/317

(58) Field of Classification Search ..... 53/490, 53/317, 331.5
See application file for complete search history.

(56) References Cited

U.S. PATENT DOCUMENTS

| | | | | |
|---|---|---|---|---|
| 3,303,633 | A | 2/1967 | Wilhere | |
| 3,435,587 | A | 4/1969 | Weller | |
| 4,178,733 | A | 12/1979 | Dankert | |
| 4,254,603 | A * | 3/1981 | Obrist | 53/490 |
| 4,295,320 | A | 10/1981 | Willingham | |
| 4,357,787 | A | 11/1982 | Long | |
| 4,492,068 | A * | 1/1985 | Obrist | 53/331.5 |
| 4,559,760 | A | 12/1985 | Daniels et al. | |
| 4,635,662 | A | 1/1987 | Totten | |
| 4,662,153 | A | 5/1987 | Wozniak | |
| 4,674,264 | A * | 6/1987 | Ellis et al. | 53/331.5 |
| 4,906,147 | A | 3/1990 | Friesinger et al. | |
| 5,327,697 | A | 7/1994 | Kent | |
| 5,533,608 | A | 7/1996 | Adams et al. | |
| 5,623,806 | A | 4/1997 | Larson et al. | |
| 5,671,585 | A | 9/1997 | Peronek et al. | |

(Continued)

FOREIGN PATENT DOCUMENTS

| | | |
|---|---|---|
| WO | 0002810 | 1/2000 |

OTHER PUBLICATIONS

European Search Report dated Dec. 18, 2006; Application No. 06020817.0-1261; Applicant Adcor Industries, Inc.

*Primary Examiner*—John Sipos
(74) *Attorney, Agent, or Firm*—Howard & Howard Attorneys, P.C.

(57) ABSTRACT

A capping device fits caps onto containers by applying an axial force to the caps as they are threaded onto the containers. The capping device utilizes a drive member rotatable about an operational axis for imparting rotation to a capper body slidably coupled to the drive member. A helical spring urges the capper body away from the drive member with a biasing force. An adjustment mechanism adjusts the biasing force thereby adjusting the axial force applied to the caps as they are threaded onto the containers. A pair of retaining pins move between a latched position to prevent adjustment of the biasing force and an unlatched position to allow adjustment of the biasing force. The retaining pins are biased in the latched position to prevent inadvertent adjustment of the biasing force during use.

16 Claims, 5 Drawing Sheets

U.S. PATENT DOCUMENTS

| | | | | |
|---|---|---|---|---|
| 5,689,932 | A | 11/1997 | Peronek et al. | |
| 5,884,450 | A | 3/1999 | Ronchi | |
| 6,112,949 | A | 9/2000 | Rhodes et al. | |
| 6,158,196 | A | 12/2000 | Trebbi et al. | |
| 6,170,232 | B1 | 1/2001 | VandeGeijn | |
| 6,240,678 | B1 * | 6/2001 | Spether | 53/317 |
| 6,508,046 | B1 | 1/2003 | Resterhouse et al. | |
| 6,543,204 | B2 | 4/2003 | Gruson | |
| 6,840,024 | B2 | 1/2005 | Ronchi | |
| 6,941,724 | B2 * | 9/2005 | Arrant et al. | 53/343 |
| 6,945,011 | B2 | 9/2005 | Hidding et al. | |
| 2002/0184853 | A1 * | 12/2002 | Arrant et al. | 53/343 |

* cited by examiner

CAPPING DEVICE WITH FORCE ADJUSTMENT MECHANISM AND METHOD OF ADJUSTING

RELATED APPLICATIONS

This application claims the benefit of U.S. Provisional Patent Application Ser. No. 60/723,390, filed on Oct. 4, 2005, the advantages and disclosure of which are hereby incorporated by reference.

FIELD OF THE INVENTION

The present invention generally relates to a capping device for fitting caps onto containers, particularly beverage containers. More specifically, the present invention relates to the capping device having a configuration for applying an axial force to pre-threaded caps as they thread onto the containers. The capping device also includes an adjustment mechanism for adjusting the axial force to accommodate different applications and/or to optimize operation of a capping machine.

BACKGROUND OF THE INVENTION

Capping machines typically utilize multiple capping devices, also known as capping heads or headsets, for fitting pre-threaded caps onto containers to secure contents disposed inside the containers. A typical capping device includes a drive member operatively coupled to a drive source such as a drive motor or turret assembly to impart rotation to the drive member. A capper body is coupled to the drive member to rotate with the drive member and slide relative to the drive member. A cap-engaging portion mounts to a bottom of the capper body via a torque dependent clutch such that when the capper body moves downwardly to engage a cap to be threaded onto a container, the clutch limits the amount of torque transmitted to the cap. Often, a spring acts between the cap-engaging portion and the drive member to "soften" the impact of the capper body on the cap. In other words, the spring absorbs the impact of the downward motion of the capping device as the capper body contacts the cap to thread the cap onto the container. Otherwise, the cap may not properly fit on the container.

In some systems, the biasing force provided by the spring is adjustable to adjust the axial force that ultimately acts on the caps. In these systems, a collar with inner threads mates with outer threads on the drive member such that the collar can be threaded or unthreaded on the drive member to move the collar upward or downward, respectfully. The spring, acting between the collar and the capper body, is compressed or decompressed when the collar is threaded or unthreaded on the drive member, respectfully, thereby adjusting the biasing force. To prevent the collar from moving and prevent the biasing force from changing, a setscrew locks the collar in place at a predetermined adjustment position on the drive member. However, the setscrew may be prone to movement during use.

The vibration to the capping device caused by rotation and upward and downward movement associated with repetitive operation may inadvertently release the setscrew from position thereby resulting in unwanted movement of the collar out from the predetermined adjustment position thereby undesirably adjusting the biasing force. Therefore, there is a need in the art for a device that prevents inadvertent adjustment of the biasing force. There is also a need in the art for a device that includes a manner of being able to determine the change in the biasing force during adjustment such that a user can set each of the multiple capping devices in the capping machine to a desired force setting.

SUMMARY OF THE INVENTION AND ADVANTAGES

The present invention provides a capping device for fitting caps onto containers by applying an axial force to the caps as they are threaded onto the containers. The capping device comprises a drive member for rotating about an operational axis. A capper body is slidably coupled to the drive member and rotatably fixed to the drive member. As a result, the capper body slides relative to the drive member along the operational axis during use and rotates with the capper body about the operational axis during use. A biasing member urges the capper body away from the drive member with a biasing force. An adjustment mechanism adjusts the biasing force thereby adjusting the axial force applied to the caps as they are threaded onto the containers. A retaining mechanism prevents adjustment of the biasing force in a latched position and allows adjustment of the biasing force in an unlatched position. The retaining mechanism includes a locking element movable between the latched and unlatched positions. The retaining mechanism also includes a biasing component biasing the locking element in the latched position to prevent inadvertent adjustment of the biasing force during use. As a result, unwanted adjustment of the biasing force is avoided thereby improving the consistency in the axial force applied to the caps as they are threaded onto the containers and reducing the fouling of caps and downtime that may occur when the biasing force is inadvertently adjusted.

In another aspect of the present invention, the retaining mechanism includes a plurality of discrete catches disposed on the drive member for receiving the locking element. In this instance, the locking element is placed in one of the plurality of discrete catches in the latched position to prevent adjustment of the biasing force and the locking element moves out of the plurality of discrete catches in the unlatched position to allow adjustment of the biasing force.

In another aspect of the present invention, a plurality of visual markings corresponding to increments of the biasing force are provided on the capping device such that a user can determine a change in the biasing force during adjustment of the biasing force.

In yet another aspect of the present invention, a bearing mechanism is disposed between the inner surface of the drive member and the outer surface of the capper body for allowing the relative sliding movement between the drive member and the capper body while preventing relative rotational movement between the drive member and the capper body. The bearing mechanism includes a plurality of inner bearing grooves defined in the inner surface of the drive member, a plurality of complimentary outer bearing grooves defined in the outer surface of the capper body, and a plurality of ball bearings disposed between the grooves. Each of the grooves is parallel to the operational axis.

The present invention also provides a method of adjusting the axial force applied to the caps as they are threaded onto the containers. The method includes moving the adjustment mechanism to a predetermined adjustment position to adjust the biasing force of the biasing member thereby adjusting the axial force applied to the caps as they are threaded onto the containers. The method further includes retaining the adjustment mechanism in the predetermined adjustment position with the locking element to prevent further adjustment of the biasing force and biasing the locking element in the latched position to retain the adjustment mechanism normally in the predetermined adjustment position.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
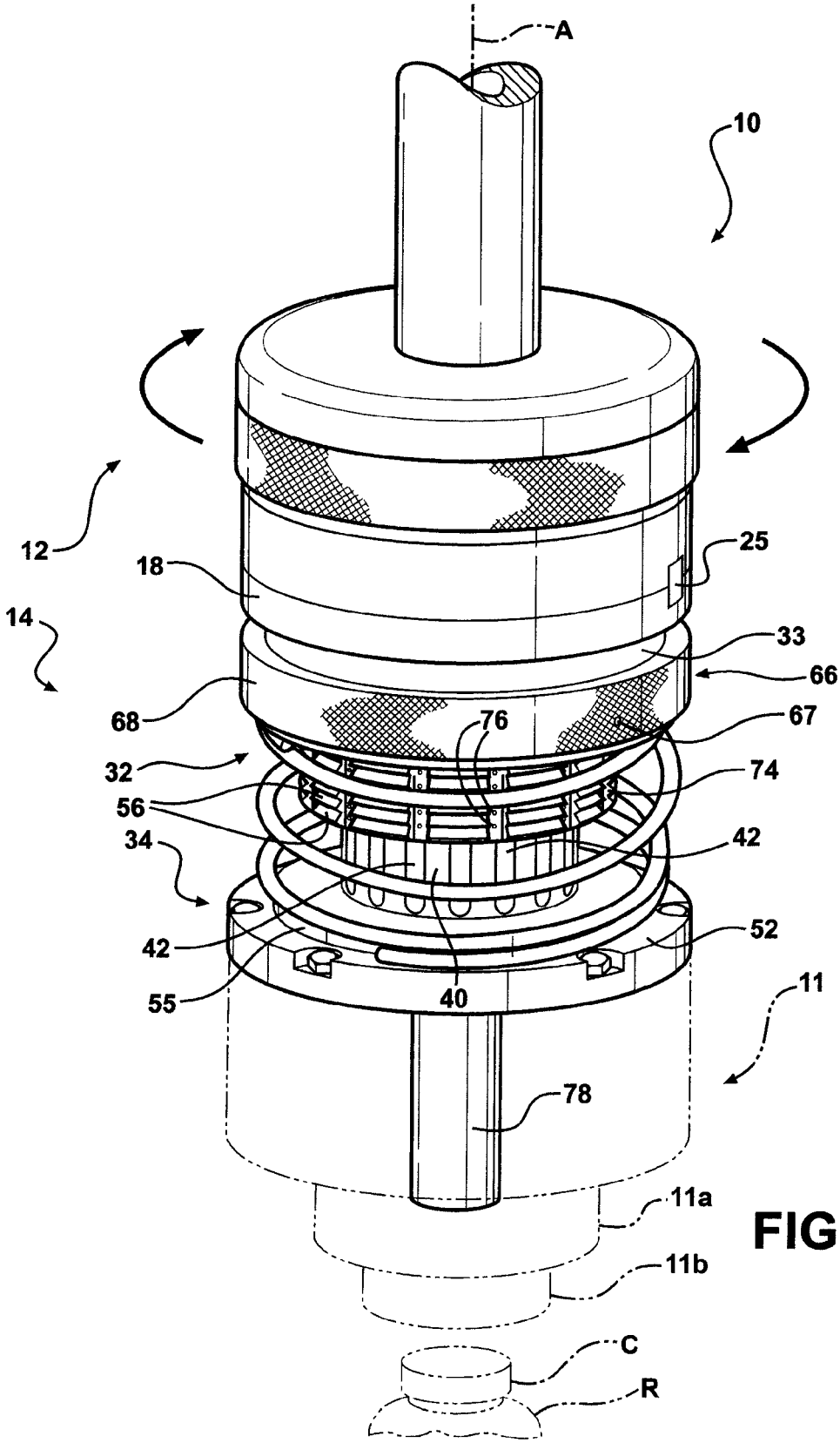
FIG. 1 is a perspective view of a capping device.
Figure 2:
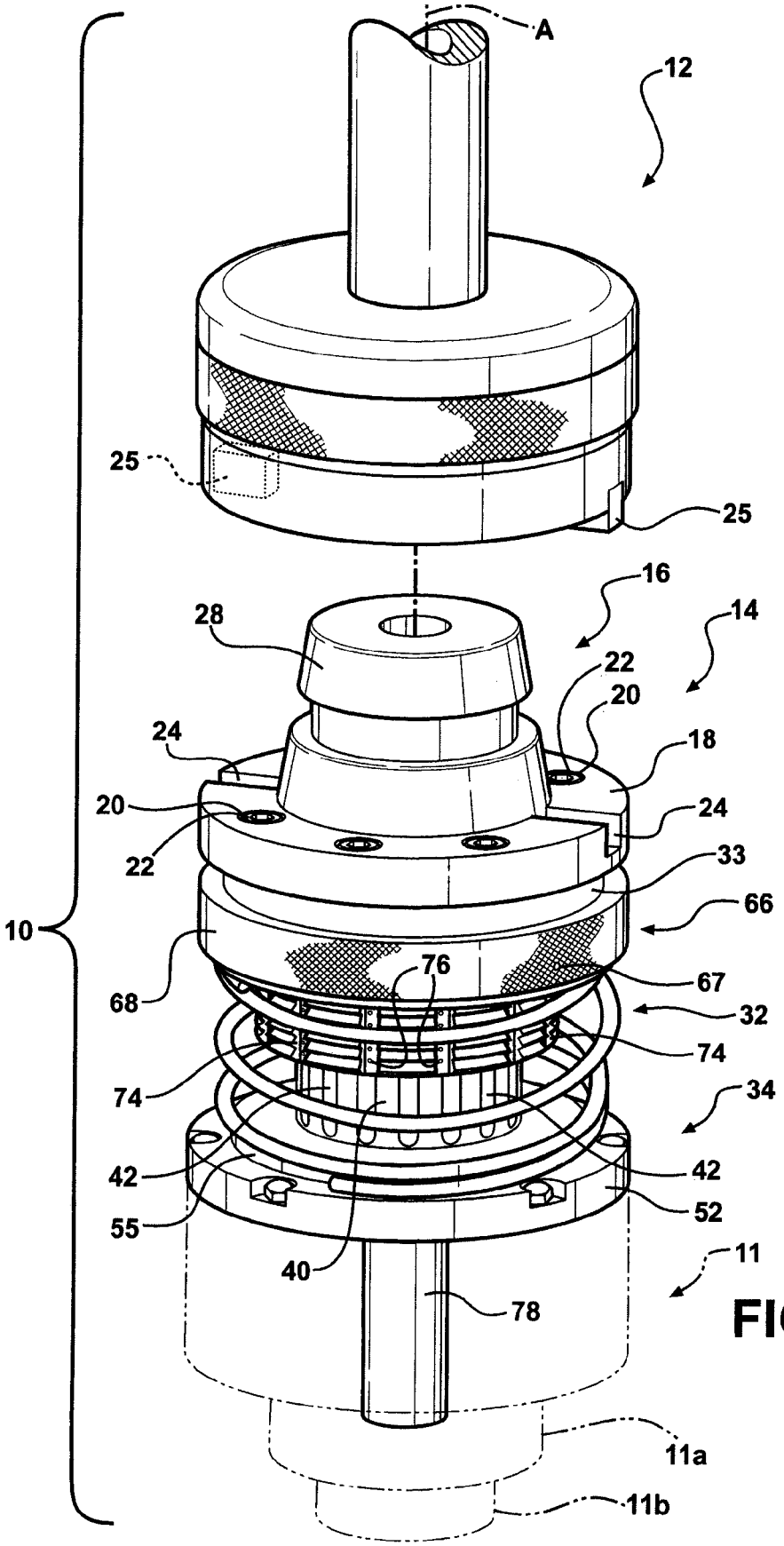
FIG. 2 is another perspective view of the capping device set with an upper portion being spaced from a lower portion.

Referring to the Figures wherein like numerals indicate like or corresponding parts throughout the several views, a capping device is generally shown at 10 in FIGS. 1 and 2. The capping device 10 includes an upper portion 12 and a lower portion 14. As discussed in greater detail below, the upper portion 12 mounts to a capping machine (not shown), which imparts rotation to the capping device 10 about an operational axis A via a drive motor, turret assembly, or other drive source. The lower portion 14 has a capping unit 11 (shown in phantom) mounted at a lower end thereof. The capping unit 11 may comprise a clutch 11*a* and a cap-engaging portion 11*b* such as disclosed in U.S. Pat. No. 6,240,678, hereby incorporated by reference. The rotation of the capping device 10 ultimately provides torque to the cap-engaging portion 11*b* in a conventional manner to thread pre-threaded caps C onto containers R as the containers R and the caps C pass through the capping machine. The capping device 10 simultaneously applies an axial force to the caps C as they are threaded onto the containers R.

Referring to FIGS. 1 and 2, the lower portion 14 of the capping device 10 is removable from the upper portion 12 for servicing and/or for changing the type of capping unit 11 for different applications. The lower portion 14 of the capping device 10 shall be described in detail below. A detailed description of the upper portion 12 and the manner in which the lower portion 14 quickly connects and disconnects from the upper portion 12 is described and claimed in copending application Ser. No. 11/538,715, filed on even date herewith, which is hereby incorporated by reference.

Figure 3:
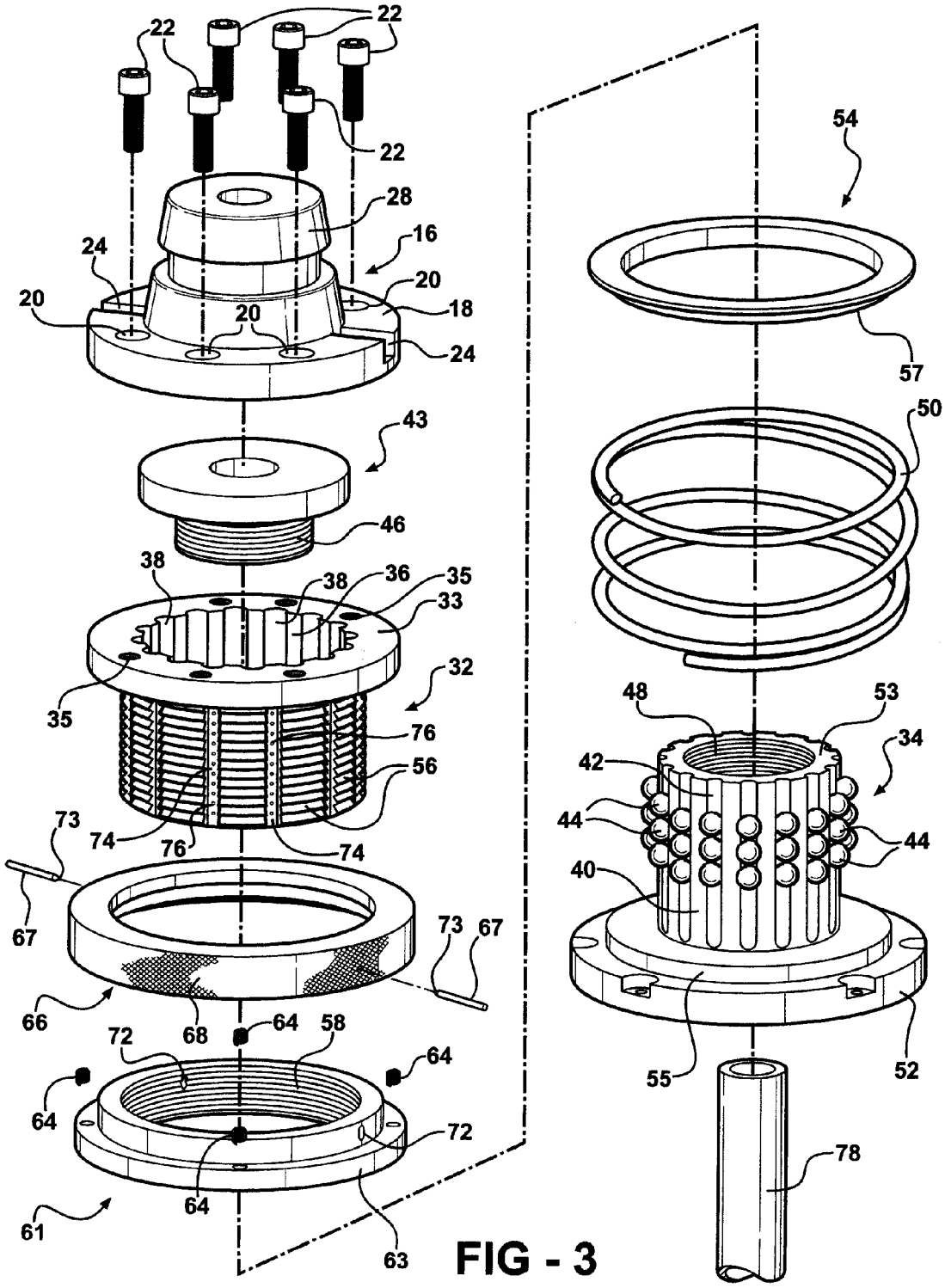
FIG. 3 is an exploded perspective view of the capping device of FIG. 1.

Referring to FIGS. 2 and 3, the lower portion 14 of the capping device 10 includes a connector 16 for inserting into the upper portion 12 to connect the lower portion 14 to the upper portion 12. The connector 16 has a base flange 18 defining a plurality of openings 20 and a pair of channels 24. Drive keys 25, which are fixed to the upper portion 12, fit snugly within the channels 24 when the lower portion 14 is connected to the upper portion 12. The drive keys 25 transfer rotation from the upper portion 12 to the lower portion 14. A tapered body 28 is disposed on the base flange 18 and extends upwardly from the base flange 18 for engaging the upper portion 12, as further described in the copending application hereby incorporated by reference.

Figure 4:
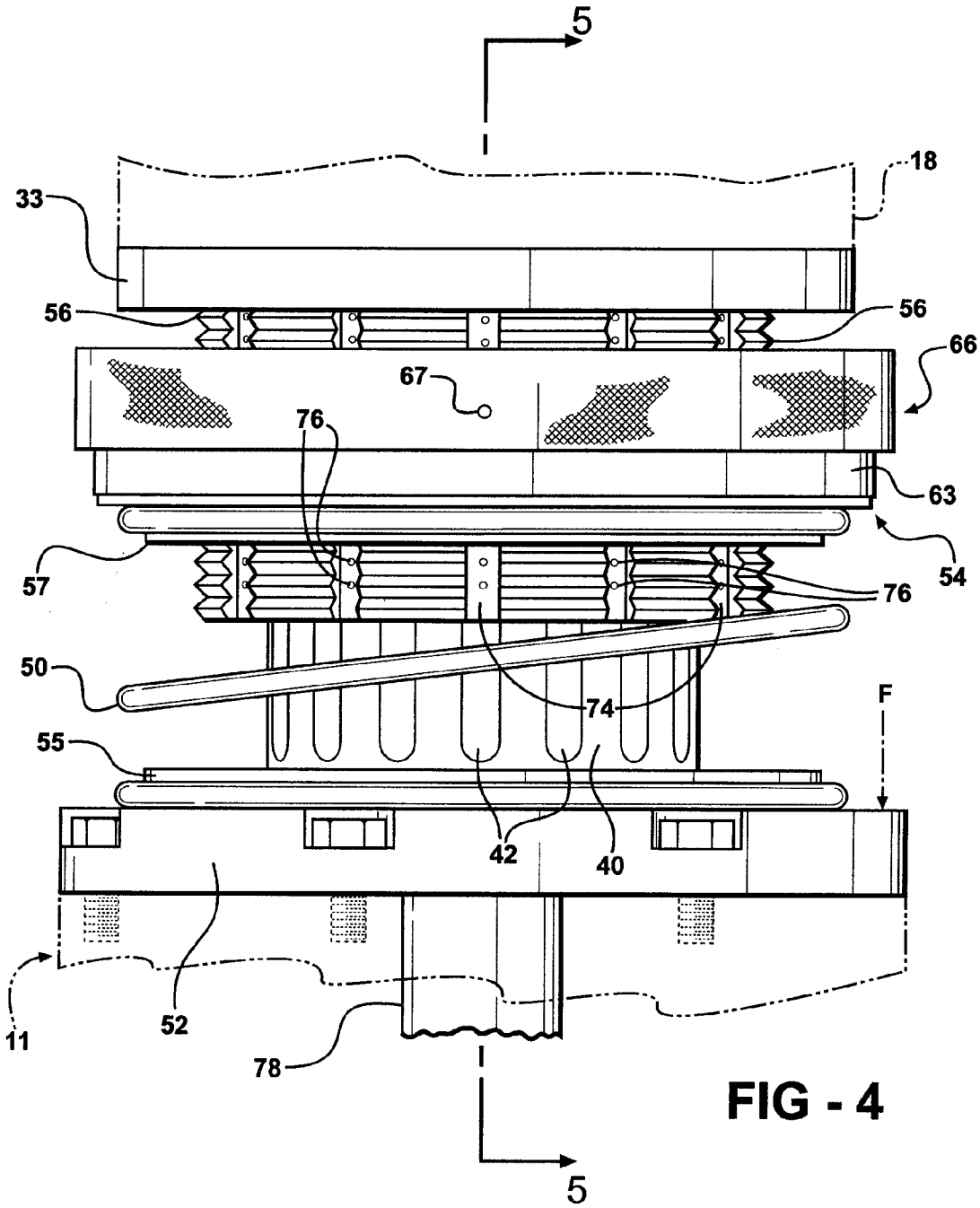
FIG. 4 is a partial side view of the lower portion of the capping device.
Figure 5:
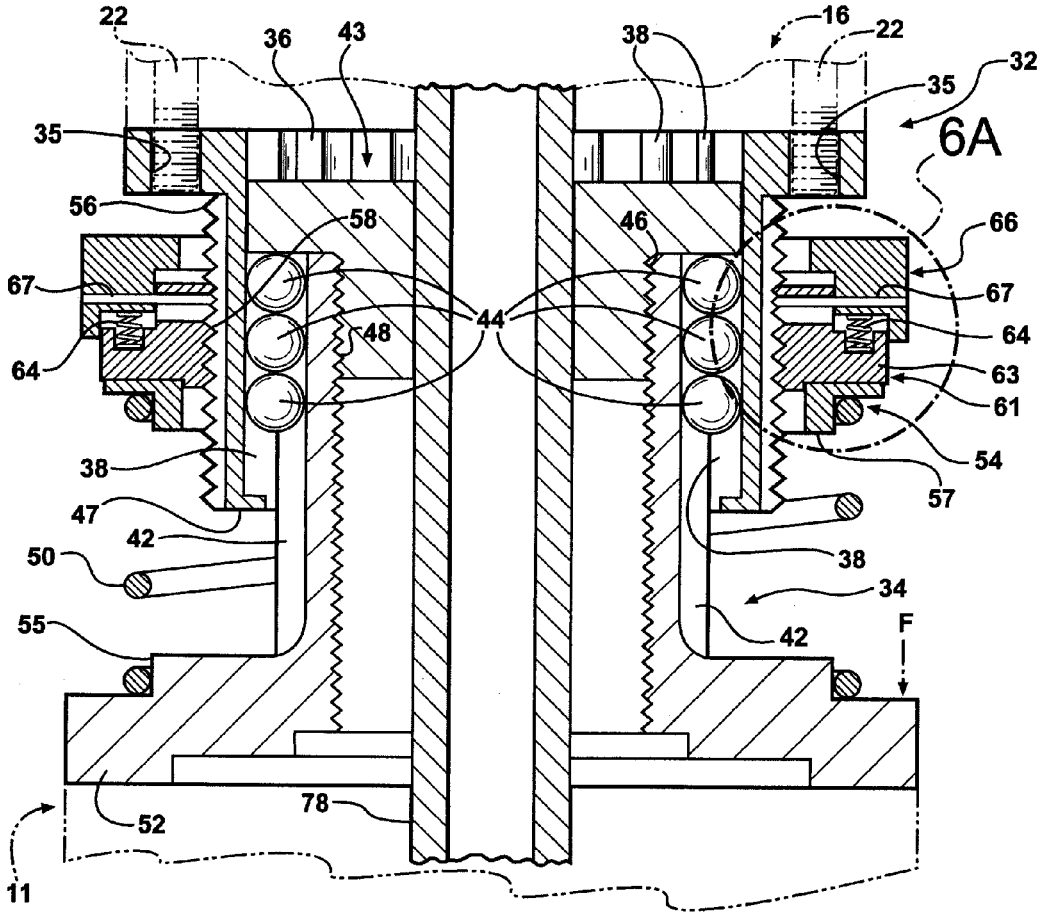
FIG. 5 is a cross-sectional view of the lower portion of the capping device taken along the line 5-5 in FIG. 4.

Referring to FIGS. 3-5, a drive sleeve 32 having a cylindrical shape mounts to the connector 16. The drive sleeve 32 has an upper flange 33 with a plurality of openings 35. Fasteners 22 insert through the openings 20 in the base flange and the openings 35 in the upper flange 33 to fix the drive sleeve 32 to the connector 16. Thus, when the upper portion 22 rotates about the operational axis A and imparts rotation to the connector 16 via the drive keys 26, the drive sleeve 32 also rotates with the connector 16.

A capper body 34 is slidably coupled to the drive sleeve 32 and rotatably fixed to the drive sleeve 32 such that the capper body 34 slides relative to the drive sleeve 32 along the operational axis A during use and rotates with the drive sleeve 32 about the operational axis A during use. The capper body 34 includes a connector flange 52 for attaching the capping unit 11 (shown in phantom in FIGS. 1 and 2) in a conventional manner. An inner sleeve 53 having a cylindrical shape extends upwardly from the connector flange 52 to inside the drive sleeve 32.

A bearing mechanism acts between the inner sleeve 53 and the drive sleeve 32 to provide the relative sliding movement and fixed rotational movement between the capper body 34 and the drive sleeve 32. The bearing mechanism includes a plurality of inner bearing grooves 38 defined on an inner surface 36 of the drive sleeve 32, parallel to the operational axis A. Likewise, the bearing mechanism includes a plurality of complimentary outer bearing grooves 42 defined on an outer surface 40 of the capper body 34. The outer bearing grooves 42 align with the inner bearing grooves 38 parallel to the operational axis A.

The bearing mechanism further includes ball bearings 44 captured between the inner 38 and outer 42 bearing grooves. The grooves 38, 42 and ball bearings 44 allow the capper body 34 to move smoothly upwardly and downwardly along the operational axis A relative to the drive sleeve 32. At the same time, the ball bearings 44 prevent relative rotation between the drive sleeve 32 and the capper body 34. Thus, the drive sleeve 32 acts as a rotational drive member for rotating the capper body 34 about the operational axis A. Preferably, there are at least three sets of inner 38 and outer 42 bearing grooves with the ball bearings 44 disposed therebetween. In one embodiment, sixteen sets of inner 38 and outer 42 bearing grooves are employed with four ball bearings 44 fall within each set of grooves 38, 42. In this embodiment, the ball bearings 44 are less than one-quarter inch in diameter.

A retainer 43 is disposed inside the drive sleeve 32 to engage the capper body 34. The retainer 43 includes threads 46 on an outer surface thereof configured to engage threads 48 disposed on an inner surface of the capper body 34. An upper rim of the retainer 43 retains the ball bearings 44 within the bearing grooves 38, 42. Similarly, the drive sleeve 32 includes a lower rim 47 (see FIG. 5) that retains the ball bearings 44 at an opposite end. Although not shown, the upper rim of the retainer 43 may include an opening for receiving a fastener to secure the retainer 43 to a top of the inner sleeve 53 of the capper body 34. Referring briefly to the exploded view of FIG. 3, the ball bearings 44 are shown suspended in the outer bearing grooves 42. It should be appreciated that this is for illustrative purposes only. During actual assembly, the drive sleeve 32 is first slid over the capper body 34 and the grooves 38, 42 are aligned. Then, with the grooves 38, 42 aligned, the ball bearings 44 are disposed in the corresponding pairs of grooves 38, 42 and captured between the lower rim 47 and the upper rim of the retainer 43.

A biasing member 50 is disposed between the drive sleeve 32 and the capper body 34 to urge the capper body 34 away from the drive sleeve 32 with a biasing force F. The biasing member 50 is preferably a helical spring 50 disposed on the base flange 52 of the capper body 34 about an annular step 55. A bellow spring (not shown) could replace the helical spring 50. As shown, a spring washer 54 with a downwardly facing rim 57 is disposed on top of the helical spring 50 with the rim 57 fitting inside the helical spring 50. The helical spring 50 provides the axial force ultimately applied by the capping unit 11 on the caps C as they are threaded onto the containers R.

Referring specifically to FIG. 5, an adjustment mechanism is operatively coupled to the helical spring 50 to adjust the biasing force F acting on the capper body 34 thereby adjusting the axial force applied to the caps C as they are threaded onto the containers R by the selected capping unit 11. The adjustment mechanism includes outer threads 56 disposed on an outer surface of the drive sleeve 32. The adjustment mechanism further includes a collar 61 having an inner surface with inner threads 58 for mating with the outer threads 56 of the drive sleeve 32. A user rotates the collar 61 relative to the drive sleeve 32 between a plurality of adjustment positions to raise or lower the collar 61 along the drive sleeve 32. As a result, since the helical spring 50 constantly presses the spring washer 54 against a flange 63 of the collar 61, this movement compress or decompress the helical spring 50. This adjusts the biasing force F provided by the helical spring 50.

During operation, the collar 61 could vibrate or otherwise become dislodged from the desired adjustment position and begin to rotate upward to release the helical spring 50 and decrease the biasing force F. In order to prevent this from occurring, a retaining mechanism is operatively coupled to the adjustment mechanism to limit adjustment of the biasing force F. The retaining mechanism includes a pair of locking elements 67 movable between a latched position to prevent adjustment of the biasing force F and an unlatched position to allow adjustment of the biasing force F. The locking elements 67 are further defined as retaining pins 67. The retaining mechanism further includes a series of vertical channels 74 defined in the outer surface 40 of the drive sleeve 32, parallel to the operational axis A, for receiving the retaining pins 67 in the latched position. The vertical channels 74 operate as a plurality of discrete and spaced catches for the retaining pins 67.

A gripping sleeve 66 is fixed to the retaining pins 67 to move the retaining pins 67 between the latched and the unlatched positions. More specifically, the retaining pins 67 interconnect the gripping sleeve 66 and the collar 61. In this embodiment, each of the retaining pins 67 includes a first end fixed to the gripping sleeve 66 in a press-fit manner and a second, tapered end extending into elongated slots 72 defined in the collar 61. The slots 72 penetrate through the inner threads 58 of the collar 61. The tapered ends of the retaining pins 67 are shaped to align with the inner threads 58 of the collar 61 when the retaining pins 67 are in the unlatched position. More specifically, the tapered ends include a tapered section 73 matching the shape of the inner threads 58. In one embodiment, the tapered section 73 includes a 60-degree taper to match a 60-degree taper of the inner threads 58.

Figure 6A:
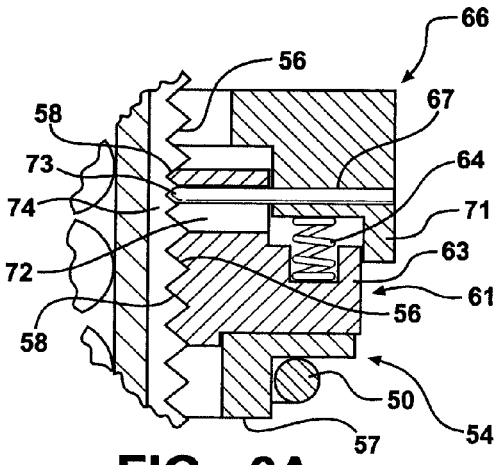
FIG. 6A is a blown-up cross-sectional view of a retaining mechanism and adjustment mechanism of the lower portion from FIG. 5 with the retaining mechanism shown in the latched position.

Referring to FIG. 6A, the retaining pins 67 protrude through the slots 72 out of alignment with the inner threads 58 of the collar 61 in the latched position. Here, the second ends of the retaining pins 67 are disposed in one of the vertical channels 74. Since the second ends of the retaining pins 67 do not align with the inner threads 58 in this latched position, the collar 61 cannot rotate relative to the drive sleeve 32. In other words, the second ends of the retaining pins 67 abut the outer threads 56 of the drive sleeve 32 in either rotational direction. Thus, the retaining pins 67 cannot move out from the vertical channel 74. This is the normal position of the retaining pins 67.

Figure 6B:
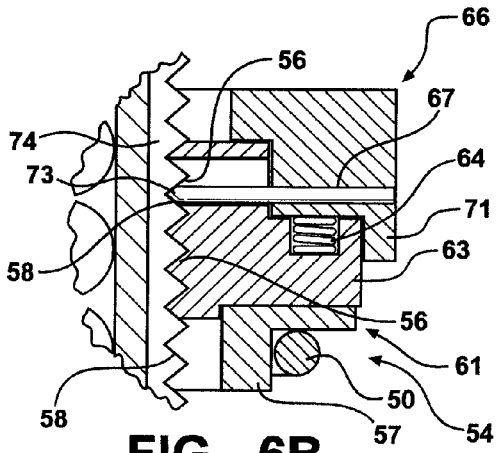
FIG. 6B is a blown-up cross-sectional view of the retaining mechanism and the adjustment mechanism of the lower portion from FIG. 5 with the retaining mechanism shown in the unlatched position.

Referring to FIG. 6B, gripping sleeve 66 has been moved downwardly such that the retaining pins 67 protrude through the slots 72 in alignment with the inner threads 58 of the collar 61. This is the unlatched position of the retaining pins 67. Now, the second ends of the retaining pins 67 are aligned with the inner threads 58 to mate with the outer threads 56 of the drive sleeve 32. Thus, the collar 61 can be rotated between the plurality of adjustment positions to adjust the biasing force F.

A plurality of biasing components 64, further defined as compression springs 64, are circumferentially spaced in recesses along the flange 63 of the collar 61 to bias the gripping sleeve 66 upwardly away from the flange 63 to normally place the retaining pins 67 in the latched position and prevent inadvertent adjustment of the biasing force F during use. The gripping sleeve 66, which includes a textured outer surface 68 for grasping by a user, includes a lip 71 that extends downwardly beyond the collar 61 to conceal the compression springs 64.

During use, the user pulls downwardly on the gripping sleeve 66 which pulls the retainer pins 67 to a bottom of the slots 72 in the collar 61 (see FIG. 6B). The tapered sections 73 of the retaining pins 67 are thereby aligned with the inner threads 58 such that the retaining pins 67 can move through the outer threads 56 to rotate the collar 61 relative to the drive sleeve 32 to compress or decompress the helical spring 50. Once the desired adjustment position of the collar 61 is found, the user releases the gripping sleeve 66. If the retaining pins 67 are not already aligned in one of the vertical channels 74, further rotation of the collar 61 in either direction will automatically position the retaining pins 67 in the next available channel 74. Once the retaining pins 67 are in a vertical channel 74, the compression springs 64 automatically bias the gripping sleeve 66 upwardly and return the retaining pins 67 to a top of the slots 72 in the collar 61 in the latched position (see FIG. 6A). A height of the slots 72 in the collar 61 is equal to one-half the pitch distance of the inner threads 58. Hence, the retaining pins 67, which remain in the appropriate vertical channel 74, are now aligned with a crest of the outer threads 56, as shown in FIG. 6A, such that further rotation of the collar 61 in either direction is prevented.

Referring back to FIGS. 3 and 4, a series of visual markings or markers 76 are disposed on the outer surface 40 of the drive sleeve 32 in at least a few, if not all, of the vertical channels 74 to indicate the amount of the biasing force F, i.e., compression force, such as in pounds, provided by the helical spring 50 so that a user can determine the change in the biasing force F that is made when the biasing force F is adjusted.

A tube 78 extends through the drive sleeve 32 and the capper body 34 in the lower portion 14. The tube 78 is used with the capping unit 11 for purposes well known to those skilled in the art and will not be described in detail.

Preferably, each of the above-described components are formed of metal or metal alloys such as stainless steel, aluminum, and the like. Other suitable materials may also be used to form these components.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A capping device for fitting caps onto containers by applying an axial force to the caps as they are threaded onto the containers, said device comprising;

a drive member for rotating about an operational axis, a capper body slidably coupled to said drive member and rotatably fixed to said drive member such that said capper body slides relative to said drive member along said operational axis during use and rotates with said drive member about said operational axis during use, a biasing member urging said capper body away from said drive member with a biasing force, an adjustment mechanism operatively coupled to said biasing member for adjusting said biasing force thereby adjusting the axial force applied to the caps as they are threaded onto the containers, and a retaining mechanism including a locking element movable between a latched position to prevent adjustment of said biasing force and an unlatched position to allow adjustment of said biasing force, said retaining mechanism including a plurality of discrete catches disposed radially outwardly on said drive member wherein said locking element is disposed in one of said plurality of discrete catches in said latched position to prevent adjustment of said biasing force and said locking element is movable out of said one of said plurality of discrete catches in said unlatched position to allow adjustment of said biasing force.

2. The device as set forth in claim 1 wherein said retaining mechanism includes a biasing component operatively coupled to said locking element for biasing said locking element in said latched position to prevent inadvertent adjustment of said biasing force during use.

3. The device as set forth in claim 2 wherein said drive member has an outer surface and said adjustment mechanism includes outer threads disposed on said outer surface and said adjustment mechanism further includes a collar having an inner surface with inner threads for mating with said outer threads of said drive member to allow rotation of said collar relative to said drive member between a plurality of adjustment positions.

4. The device as set forth in claim 3 wherein said biasing member is disposed between said collar and said capper body.

5. The device as set forth in claim 3 wherein said collar defines an elongated slot penetrating through said inner threads and said locking element protrudes through said slot in alignment with said inner threads of said collar in said unlatched position to mate with said outer threads of said drive member as said collar is rotated between said plurality of adjustment positions.

6. The device as set forth in claim 5 wherein said locking element protrudes through said slot out of alignment with said inner threads of said collar in said latched position to prevent mating with said outer threads of said drive member and prevent rotation of said collar relative to said drive member.

7. The device as set forth in claim 6 wherein said retaining mechanism includes a second locking element movable between a latched position to prevent rotation of said collar relative to said drive member and an unlatched position to allow rotation of said collar relative to said drive member.

8. The device as set forth in claim 7 wherein said collar includes a second elongated slot penetrating through said inner threads opposite said other slot and said second locking element protrudes through said second slot in alignment with said inner threads of said collar in said unlatched position and out of alignment with said inner threads of said collar in said latched position.

9. The device as set forth in claim 8 including a gripping member operatively coupled to said collar and said locking elements for manually moving said locking elements in said slots between said latched and unlatched positions.

10. The device as set forth in claim 9 wherein said biasing component includes a plurality of springs biasing said gripping member to place said locking elements normally in said latched position.

11. The device as set forth in claim 10 wherein said locking elements are further defined as retaining pins with each of said retaining pins including a first end fixed to said gripping member and a second end extending into said slots wherein said second end is shaped to align with said inner threads of said collar in said unlatched position.

12. The device as set forth in claim 2 wherein said plurality of discrete catches include a plurality of vertical channels defined in said outer surface of said drive member for receiving said locking element in said latched position.

13. The device as set forth in claim 12 including a plurality of visual markings on said outer surface of said drive member in said vertical channels that correspond to increments of said biasing force such that a user can determine a change in said biasing force during adjustment of said biasing force.

14. The device as set forth in claim 1 wherein said biasing member is further defined as a compression spring with said adjustment mechanism configured for adjusting compression of said compression spring to adjust said biasing force.

15. The device as set forth in claim 1 including a bearing mechanism disposed between said drive member and said capper body for allowing relative sliding movement between said drive member and said capper body while preventing relative rotational movement between said drive member and said capper body.

16. The device as set forth in claim 15 wherein said bearing mechanism includes a plurality of inner bearing grooves defined in an inner surface of said drive member, a plurality of complimentary outer bearing grooves defined in an outer surface of said capper body, and a plurality of ball bearings disposed between said grooves, each of said grooves being aligned parallel to said operational axis.

* * * * *